US007677760B2

(12) United States Patent
Simon

(10) Patent No.: US 7,677,760 B2
(45) Date of Patent: Mar. 16, 2010

(54) EFFICIENT AND UNIFORMLY DISTRIBUTED ILLUMINATION FROM MULTIPLE SOURCE LUMINAIRES

(76) Inventor: Jerome H. Simon, 70 Sumner St., Newton Centre, MA (US) 02459

( * ) Notice: Subject to any disclaimer, the term of this patent is extended or adjusted under 35 U.S.C. 154(b) by 0 days.

(21) Appl. No.: 11/034,395

(22) Filed: Jan. 12, 2005

(65) Prior Publication Data

US 2006/0291207 A1 Dec. 28, 2006

Related U.S. Application Data

(60) Provisional application No. 60/536,477, filed on Jan. 14, 2004.

(51) Int. Cl.
*F21V 1/00* (2006.01)
*F21V 11/00* (2006.01)
*F21V 5/00* (2006.01)

(52) U.S. Cl. ..... 362/235; 362/237; 362/240; 362/245

(58) Field of Classification Search ..... 362/235, 362/237, 240, 245
See application file for complete search history.

(56) References Cited

U.S. PATENT DOCUMENTS

| | | | | |
|---|---|---|---|---|
| 2,088,024 | A * | 7/1937 | Baber | 362/33 |
| 4,159,511 | A * | 6/1979 | Dejonc | 362/299 |
| 5,130,908 | A * | 7/1992 | Simon | 362/150 |
| 5,383,105 | A * | 1/1995 | Agut | 362/285 |
| 5,897,201 | A * | 4/1999 | Simon | 362/268 |
| 5,951,139 | A * | 9/1999 | Smith et al. | 362/33 |
| 6,270,236 | B1 * | 8/2001 | Brussog | 362/249 |
| 6,354,725 | B1 * | 3/2002 | Simon | 362/576 |
| 6,361,191 | B1 * | 3/2002 | Simon | 362/328 |
| 6,447,155 | B2 * | 9/2002 | Kondo et al. | 362/545 |
| 6,502,964 | B1 * | 1/2003 | Simon | 362/328 |
| 6,558,031 | B2 * | 5/2003 | Tiesler-Wittig | 362/511 |
| 6,572,234 | B1 * | 6/2003 | Maier et al. | 362/20 |
| 7,083,313 | B2 * | 8/2006 | Smith | 362/555 |
| 2004/0120157 | A1 * | 6/2004 | Bottesch et al. | 362/487 |
| 2005/0068777 | A1 * | 3/2005 | Popovic | 362/307 |

OTHER PUBLICATIONS

Merriam-Webster's Collegiate Dictionary, 1998, 10th Edition, p. 579.*

* cited by examiner

*Primary Examiner*—Jong-Suk (James) Lee
*Assistant Examiner*—David J Makiya
(74) *Attorney, Agent, or Firm*—Burns & Levinson LLP; Harvey Kaye; David W. Gomes

(57) ABSTRACT

Light projecting devices for integrating the light output from multiple light emitting quasi point sources into unified predetermined light patterns. The multiple light emitting quasi point sources (such as LEDs [Light Emitting Diodes]) are generally stacked with a common optical axis, each of the light emitting quasi point light sources further surrounded by a ring collimator designed to collect and project a radial beam of light away from the optical axis. In some embodiments, a series of individual collimators surround each of the light emitting quasi point sources and substitutions for the ring collimator forming an array of beams projected away from the optical axis. Further, either of the systems, whether incorporating a ring collimator or a series of individual collimators, may use reflecting surfaces to intercept and redirect the radiating collimated light into distribution patterns ranging from focused beams to ambient broad light distribution.

21 Claims, 15 Drawing Sheets

EXISTING TECHNOLOGY

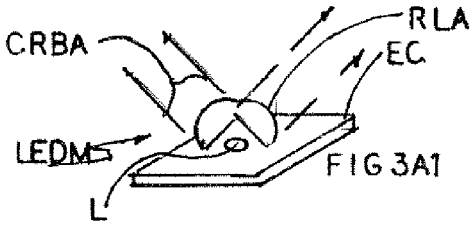
FIG 3A1
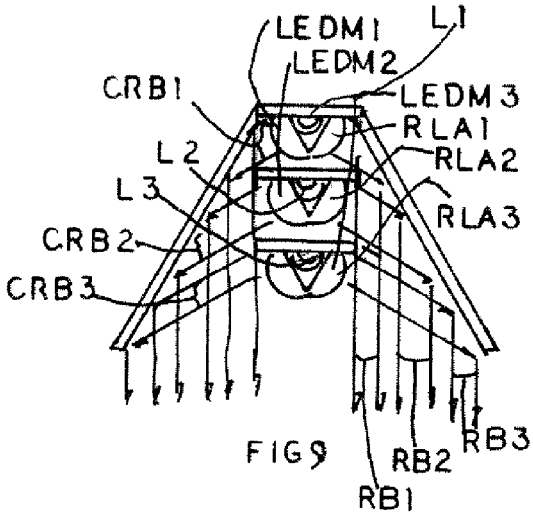
FIG 9
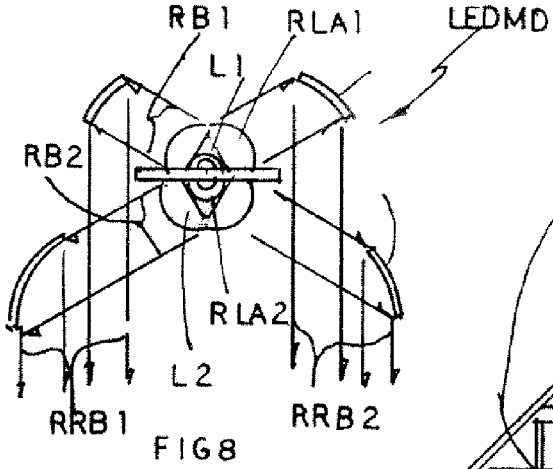
FIG 8
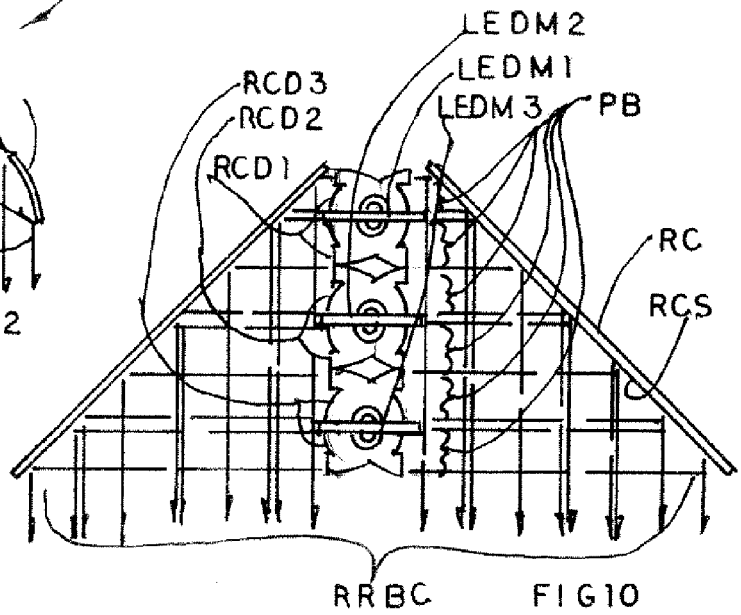
FIG 10

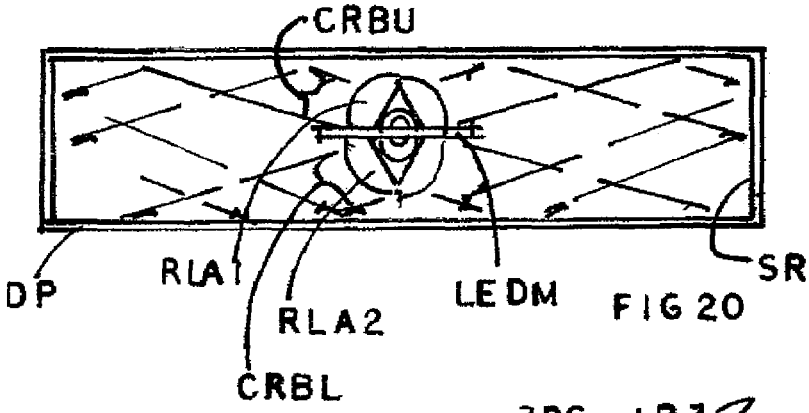
FIG 20
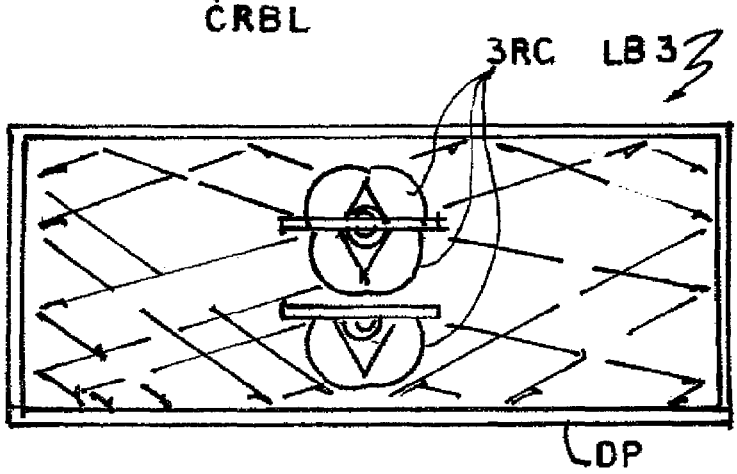
FIG 20A
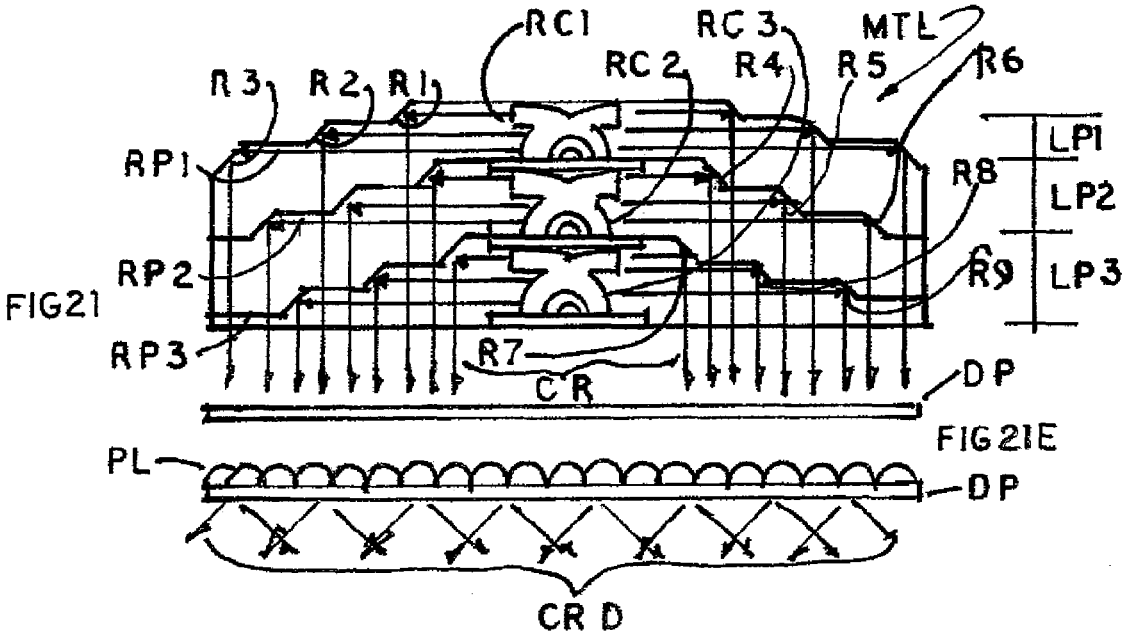
FIG21
FIG21E

EFFICIENT AND UNIFORMLY DISTRIBUTED ILLUMINATION FROM MULTIPLE SOURCE LUMINAIRES

REFERENCE TO RELATED APPLICATIONS

The present application is based on and claims the priority of provisional application, Ser. No. 60/536,477 filed Jan. 14, 2004. The substance of that application is hereby incorporated herein by reference.

FIELD OF INVENTION

The present invention relates generally to the field of lighting and, more particularly, to arrangements of quasi-point light sources, such as LEDs, used in an efficient manner.

SUMMARY OF THE INVENTION

An object of this invention is to create a unified beam pattern from multiple quasi point sources such as LEDs, Halogen or HID lamps.

Another object of this invention is to mix color from groupings of multicolored light sources.

A further object of this invention is to integrate the light from multiple quasi point sources into high intensity collimated beams.

Still another object of this invention is to efficiently focus the light from multiple quasi point sources into light guides.

Still a further object of this invention is to provide uniformly distributed illumination over large architectural surfaces.

Yet another object of this invention is to provide brightly illuminated and light projecting grids and surfaces.

These light projecting devices are for integrating the light output from multiple light emitting quasi point sources into unified predetermined light patterns. The multiple light emitting quasi point sources (such as LEDs [Light Emitting Diodes]) are generally stacked with a common optical axis, each of the light emitting quasi point light sources further surrounded by a ring collimator designed to collect and project a radial beam of light away from the optical axis. In some embodiments, a series of individual collimators surround each of the light emitting quasi point sources and substitutions for the ring collimator forming an array of beams projected away from the optical axis. Further, either of the systems, whether incorporating a ring collimator or a series of individual collimators, may use reflecting surfaces to intercept and redirect the radiating collimated light into distribution patterns ranging from focused beams to ambient broad light distribution.

BRIEF DESCRIPTIONS OF DRAWINGS

These and other objects, features and advantages will be apparent from the following detailed description of preferred embodiments taken in conjunction with the accompanying drawings in which:

FIG. 1: illustrates an LED mounted to an electrical contact base.

FIG. 1A: is a cross-sectional drawing of FIG. 1.

FIG. 1C: illustrates two LEDs with the electrical contact base mounted back-to-back to each other.

FIG. 1D: illustrates two LEDs mounted back-to-back sharing the same electrical contact base.

FIG. 1E: illustrates two LEDs mounted on a transparent electrical contact base.

FIG. 1F: illustrates several LEDs mounted on opposite sides of a common electrical contact base.

FIG. 2: illustrates three LED modules, each sharing the same optical axis.

FIG. 3A: is a cross-sectional view of an LED surrounded by an off-axis ring collimator.

FIG. 3A1 is an isometric view showing an LEDM module shown in FIG. 3A.

FIG. 3B: is a variation of 3A.

FIG. 3C: is a further variation of 3A.

FIG. 4A: illustrates an LED surrounded by a compound ring collimator.

FIG. 5: illustrates a stack of LEDs, each surrounded by a ring collimator.

FIG. 6: illustrates a variation of FIG. 5.

FIG. 7: further illustrates a variation of FIG. 5.

FIG. 8: further illustrates a stack of LED modules, each surrounded by a ring collimator, further surrounded by a reflecting ring.

FIG. 8A: is a variation of FIG. 8.

FIG. 8B: illustrates the focus of light in FIG. 8A entering a light guide.

FIG. 9: illustrates a variation to FIG. 8, each composite LED and ring collimator sharing a common reflecting surface.

FIG. 10: is a variation of FIG. 9.

FIG. 11: is a variation of FIG. 8.

FIG. 11A: is a further variation of FIG. 8.

FIG. 11 B is similar to FIG. 11.

FIG. 12: is a further variation of FIG. 8, having all reflector rings sharing the same fabricated body.

FIG. 13: is a cross-section of an LED surrounded by a multiple direction collimator.

FIG. 13A: illustrates a bi-directional collimator, as in FIG. 13.

FIG. 13B: illustrates a 4-way directional collimator as in FIG. 13.

FIG. 14: illustrates a variation in the collimator of FIG. 13.

FIG. 14A: is a three-dimensional view of a 4-way collimator shown in FIG. 14.

FIG. 15: is a three-dimensional diagram of a luminaire designed to create a pattern of projected beam segments.

FIG. 15A: is a plan diagram of FIG. 15.

FIG. 15B: is a variation of FIG. 15A.

FIG. 16: is a variation of FIG. 15.

FIG. 17: illustrates an LED surrounded by a ring collimator projecting into light guides.

FIG. 17A: is a cross-sectional variation of FIG. 17.

FIG. 17B is an assembly similar to FIGS. 17 and 17A.

FIG. 18: illustrates a stack of LEDs surrounded by multiple beam collimators projecting into a light guide.

FIG. 18A: is a plan view of FIG. 18.

FIG. 20: is a cross-sectional diagram of a reflective and refractive container surrounding LED and collimating ring composites.

FIG. 20A: is a variation of FIG. 20.

FIG. 21: is a cross-sectional view of a multi-tiered luminaire comprised of light collimation modules and light pathways.

FIGS. 21A, 21B, 21C, and 21D: are variations of FIG. 21.

FIG. 21E: is a cross-sectional view of a beam modifying panel that can be used with luminaire shown in FIGS. 20, 202A, 21B, 21C, and 21D.

FIG. 22: is a cross-sectional view of a unified optical body.

FIG. 22A: is a variation of FIG. 22.

FIG. 23: is a group of stacked components as illustrated in FIG. 22.

FIG. 24: is a three-dimensional view of disk shaped unified optical body.

FIG. 24A: is a variation of FIG. 24.

FIG. 25 is an isometric view of a luminaire.

FIG. 25A: is a variation of FIG. 25.

FIG. 26: is a variation of FIG. 25.

DETAILED DESCRIPTION OF THE DRAWINGS

Figure 1:
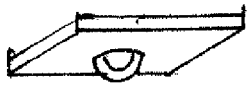
FIG. 1 shows an LED (light emitting diode) module LEDM having an electrical contact base EC and a light emitting diode L. This is existing technology.
Figure 1A:
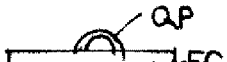
FIG. 1A shows an LED module as illustrated in FIG. 1 showing the location of the quasi-point light emitting surface QP of the LED.
Figure 3B:
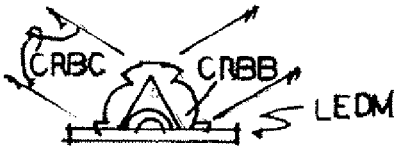
FIG. 3A illustrates an LEDM at least partially surrounded by a radial off axis radially collimating ring lens RLA projecting canted radial beam CRBA.
Figure 3A:
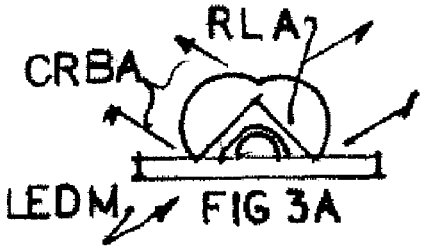

FIG. 3A1 shows an LEDM module as described in FIG. 3A comprised of an EC, an L, and an RLA projecting a CRBA.

FIG. 3B illustrates an LEDM at least partially surrounded by an off axis ring lens CRBB having a frenel cross-section projecting canted radial beam CRBC.

Figure 3C:
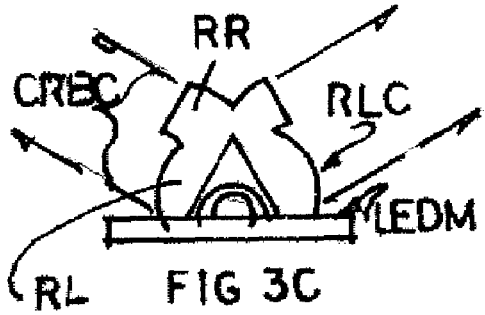

FIG. 3C illustrates an LEDM at least partially surrounded by a radial off axis collimator RLC. RLC is comprised of a piano convex, double convex, or concave convex off axis ring section RL and an internally reflective surface RR which is substantially parabolic in section. RLC projects canted radial beam CRBC.

Figure 4A:
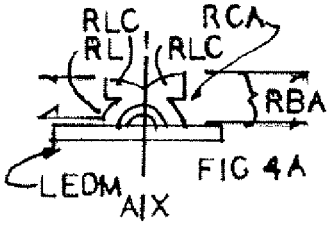

FIG. 4A illustrates an LEDM module at least partially surrounded by a compound ring collimator RCA comprised of a ring lens RL (the cross-sectional of which is described in FIG. 3C). Radial beam RBA emanating from RCA is substantially perpendicular to axis AX.

Figure 2:
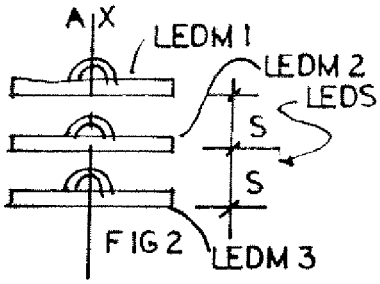
FIG. 2 shows three LEDM modules stacked above each other (LEDS) sharing axis AX. The distance S between the modules LEDM1, LEDM2 and LEDM3 vary between the modules.
Figure 5:
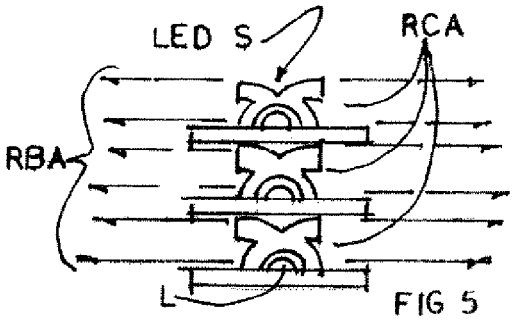

FIG. 5 illustrates a stack of LEDM modules LEDS as described in FIG. 2 as LEDM1, LEDM2 and LEDM3. Each LED at Least partially surrounded by a ring collimator RCA (described in FIG. 4A) each projecting a radial beam RBA which. Each L may be of the same or different color and the number LEDM module can be of any number. This is true of all figures showing multiple L in this filing.

Figure 6:
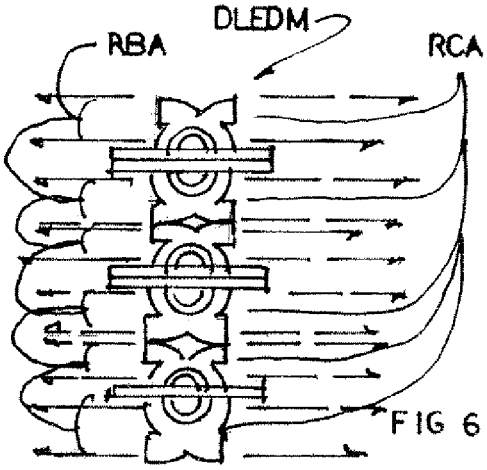
Figure 1C:
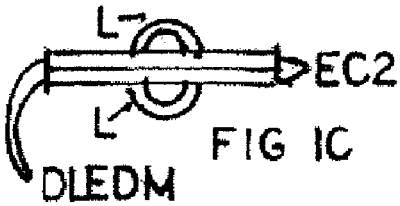
FIG. 1C illustrates two LEDM modules DLEDM having their electrical contact base EC2 mounted back to each other. Their light emitting diode surfaces L at substantially 180° to each other.
Figure 1D:
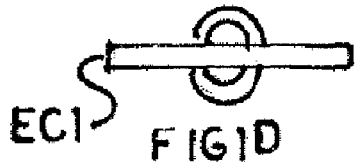
FIG. 1D illustrates a variation to FIG. 1C which is that both L components share the same electrical contact base EC1.
Figure 1F:
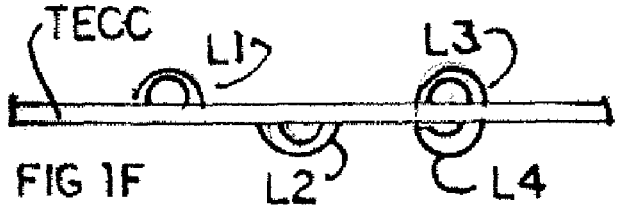
FIG. 1F shows a continuous transporting electrical contact base TECC having several L components sharing the same place both above L1 and L3 and below L2 and L4.
Figure 1E:
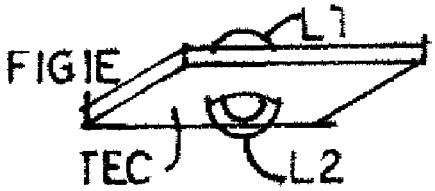
FIG. 1E is similar to FIG. 1D differing in that the electrical component base EC1 of FIG. 1D is comprised of a transparent material TEC of FIG. 1E so that L1 and L2 are visible simultaneously though TEC.

FIG. 6 illustrates a stack of DLEDM modules (as described in FIG. 1C) LEDSD (as described in FIGS. 1C and 1D). Each DLEDM is at least partially surrounded by a composite ring collimator RVA projecting a radial beam as described in FIG. 4A.

Figure 7:
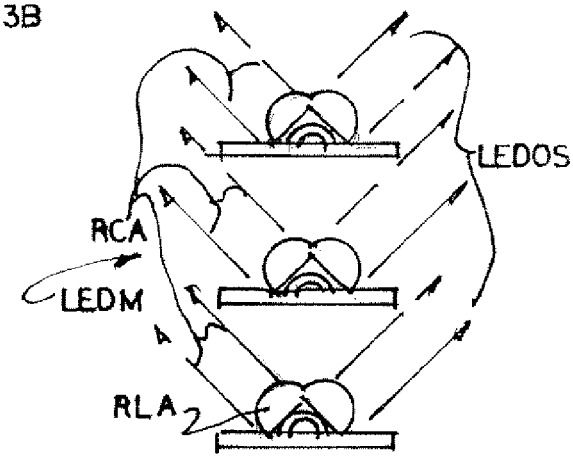

FIG. 7 illustrates a stack of LEDM modules LEDOS of which each L is at least partially surrounded by a radial off axis ring collimator (as described in FIGS. 3A, 3B, or 3C) projecting radial off axis canted radial beams RLA.

Figure 8A:
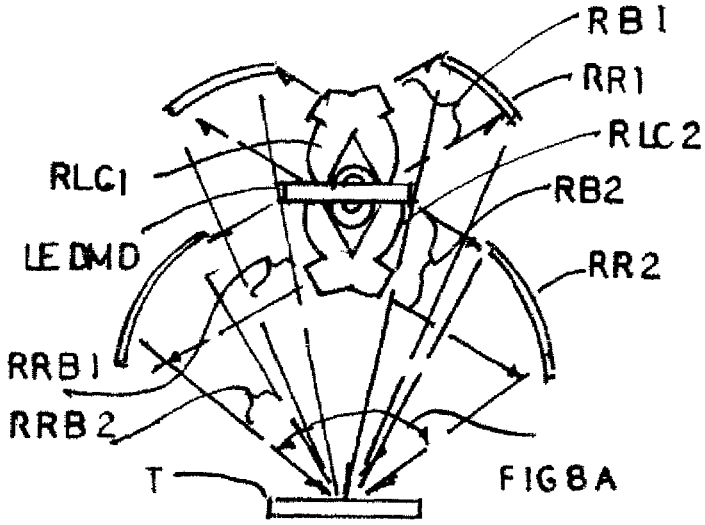
Figure 8B:
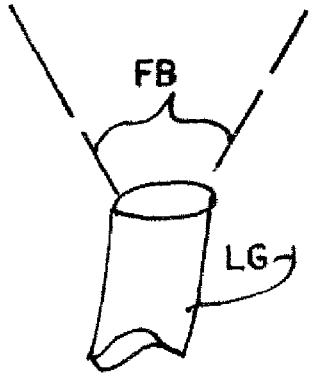

FIG. 8 illustrates an LEDMD module comprised of a single EC having back to back component L1 and L2, RLA1 and RLA2 respectively further surrounded by reflector rings R1 and R2 which are substantially conical. The sections of which are canted as to reflect the radial off axis beams RB1 and RB2 in the same direction as parallel tubular shaped beams RRB1 and RRB2. RR1 and RR2 can be canted so as to focus RRB1 an RRB2 onto a shared target area. This is further described in FIG. 8A FIG. 8A illustrates an LEDMD module similar to that illustrated in FIG. 8. L1 and L2 at least partially surrounded by a composite ring collimator RCL1 and RCL2 respectively (as described in FIG. 3*c*) further surrounded by ring reflectors RR1 and RR2 respectively reflecting canted radial beams RB1 and RB2 as conical beams RRB1 and RRB2 that overlap and focus as FB on target area T. T can be transparent, translucent, or have refracting surfaces, or be the entry to a light guide LG, as in FIG. 8B.

FIG. 8B illustrates the focused Beam FB created by the optical configuration described in FIG. 8A entering into light guide LG. LG can be a fiber optic or a reflecting tube.

FIG. 9 illustrates a stack of LEDM modules LEDM1, LEDM2, LEDM3 (as illustrated in FIG. 3). Each L (L1, L2, L3) is at least partially surrounded by a radial off axis radial collimating lenses RLA1, RLA2, and RLA3 respectively projecting radial canted beams CRB1, CRB2, CRB3 respectively onto and reflected off reflective surface RCS of substantially conical reflector RC as tubular conic beams RRB1, RRB2 and RRB3 respectively.

FIG. 10 illustrates a stack of LEDM modules (similar to shown in FIG. 6 having ring collimators RCD1, RCD2 and RCD3) LEDM1, LEDM2 and LEDM3 projecting a vertical stack of radial beams CPB onto and reflected by RCS of RC as tubular concentric beams RRBC.

Figure 11B:
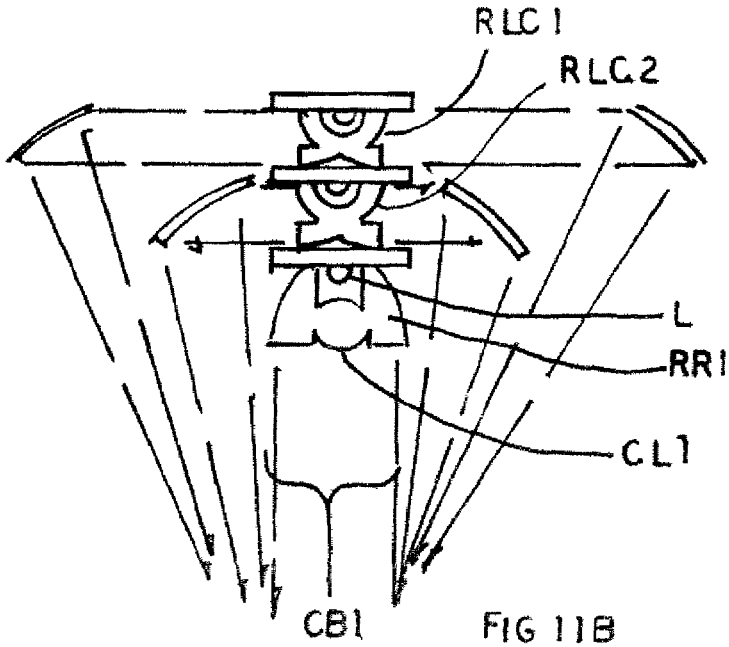
Figure 11:
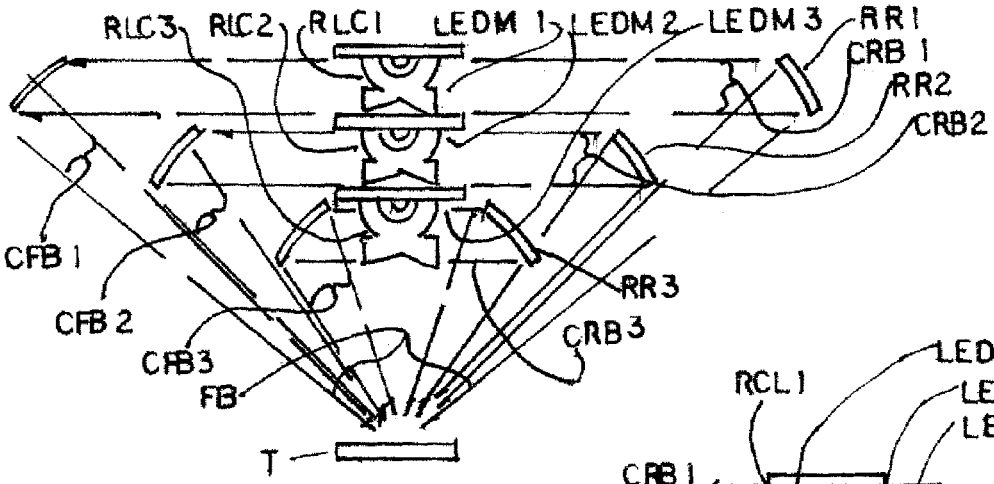

FIG. 11 illustrates a stack of LEDM modules (as illustrated in FIG. 5). LEDM1, LEDM2 and LEDM3 at least partially surrounded by composite ring collimators RLC1, RLC2 and RLC3 projecting radial beams CRB1, CRB2 and CRB3 respectively onto and be reflected by reflector rings RR1, RR2 and RR3 as radial conical beams CFB1, CFB2, and CFB3 toward and onto a common target T as a focused beam FB.

Figure 11A:
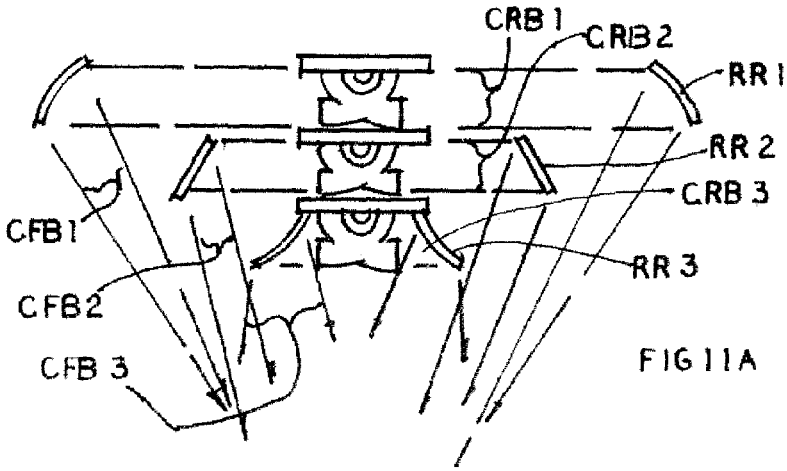

FIG. 11A is similar to that of FIG. 11 differing in that the cross-section of RR1 is concave reflecting CRB1 as CFB1 as having converging rays, the cross-section of RR2 is flat reflecting CRB2 as CFB2 the rays of which remain equally divergent to CRB2. RR3 is convex reflecting CFB three as divergent rays CFB3.

FIG. 11B is similar to FIG. 11 differing in that RLC3 of FIG. 11 has been replaced with RR1, an optical collimator comprised of a parabolic reflective surface PRS and a convex surface CLS combining to collect and project beam CB1 L can be halogen or meal halide or any other quasi point source. RR1 can be a simple parabolic or elliptical reflector.

Figure 12:
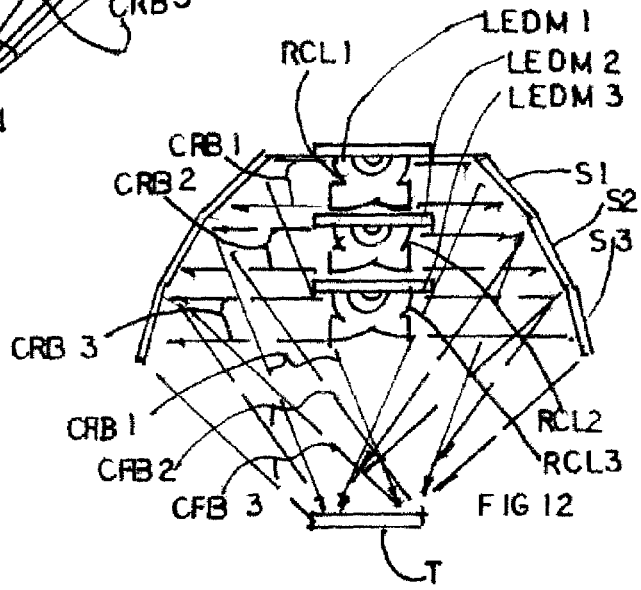

FIG. 12 illustrates a stack of LEDM modules (as illustrated in FIG. 5) at least partially surrounded by composite ring collimators RLC1, RLC2 and RLC3 respectively projecting radial collimated beams CRB1, CBR2, and CRB3 onto ring segments S1, S2, and S3 of reflector cone CR. S1 reflects and focuses CRB1 as CFB1 onto target area T, S2 reflects and focuses CRB2 as CFB2 onto target area T, S3 reflects and focuses CRB3 as CFB2 onto target area T. Focused beam FB is a composite of focused beams CFB1, CFB2 and CFB3. T can be replaced by the entry face of a solid or hollow light guide as illustrated in FIG. 8B.

FIGS. 8A, 8B, 11 and 12 illustrate mean of additive brightness, or color mixing, or color selectivity on a target area or entry to a light transmission means.

Figure 13A:
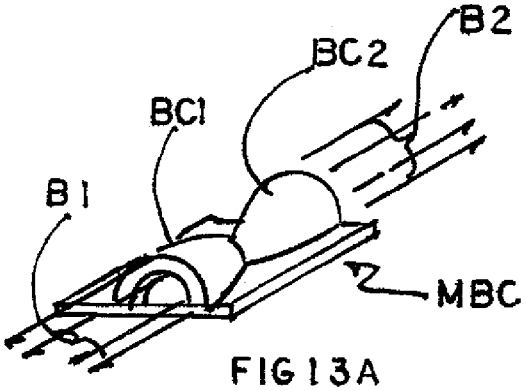
Figure 13:
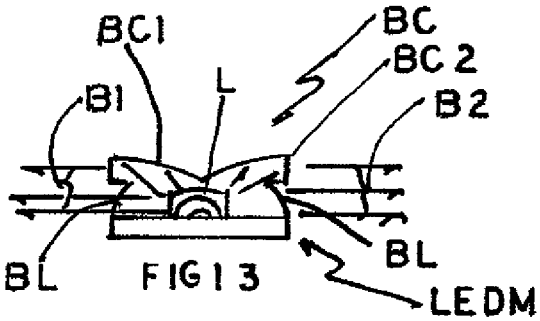

FIGS. 13 and 13A show is a multiple beam collimator comprised of an LEDM module with L at the focal length of a bidirectional collimator BC each half, BC1 and BC2 comprised of a substantially parabolic reflector PR and a lens segment BL, the section of which is described in FIG. 4A. BC1 and BC2 gather approximately one half of the light from L and direct it as collimated beams B1 and B2.

Figure 13B:
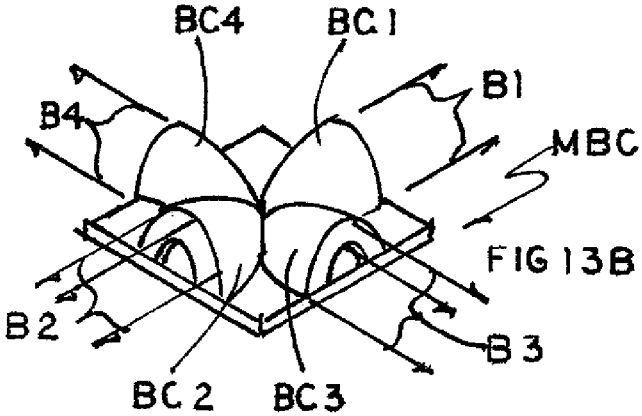

FIG. 13B shows a four way multiple beam collimator MBC comprised of four light collection elements BC1, BC2, BC3, and BC4 each having optics similar to those illustrated in FIG. 13 and at substantially at 90° to each other each projecting a beam, B1, B2, B3 and B4 especially.

Figure 14:
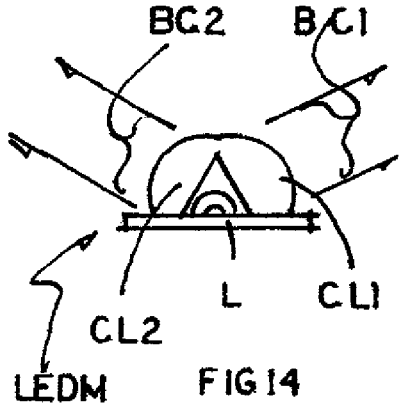
Figure 14A:
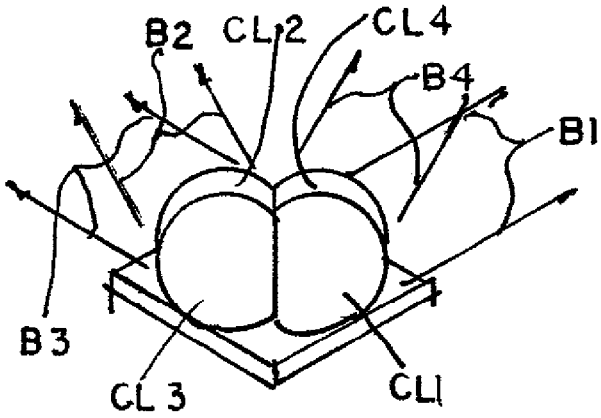

FIGS. 14 and 14A show a multiple beam collimator MBC comprised of LEDM modules and three or more collimating lenses (the sections of which are described in FIGS. 3A). For graphic purposes only two lenses are shown in FIG. 14 CL1 and CL2, each projecting a canted collimated beam BC1 and BC2 respectively. FIG. 14A illustrates for collimating lenses CL1, CL2, CL3, and CL4 disposed at substantially 90° to each other projecting collimated beams B1, B2, B3 and B4 respectively.

Figure 15:
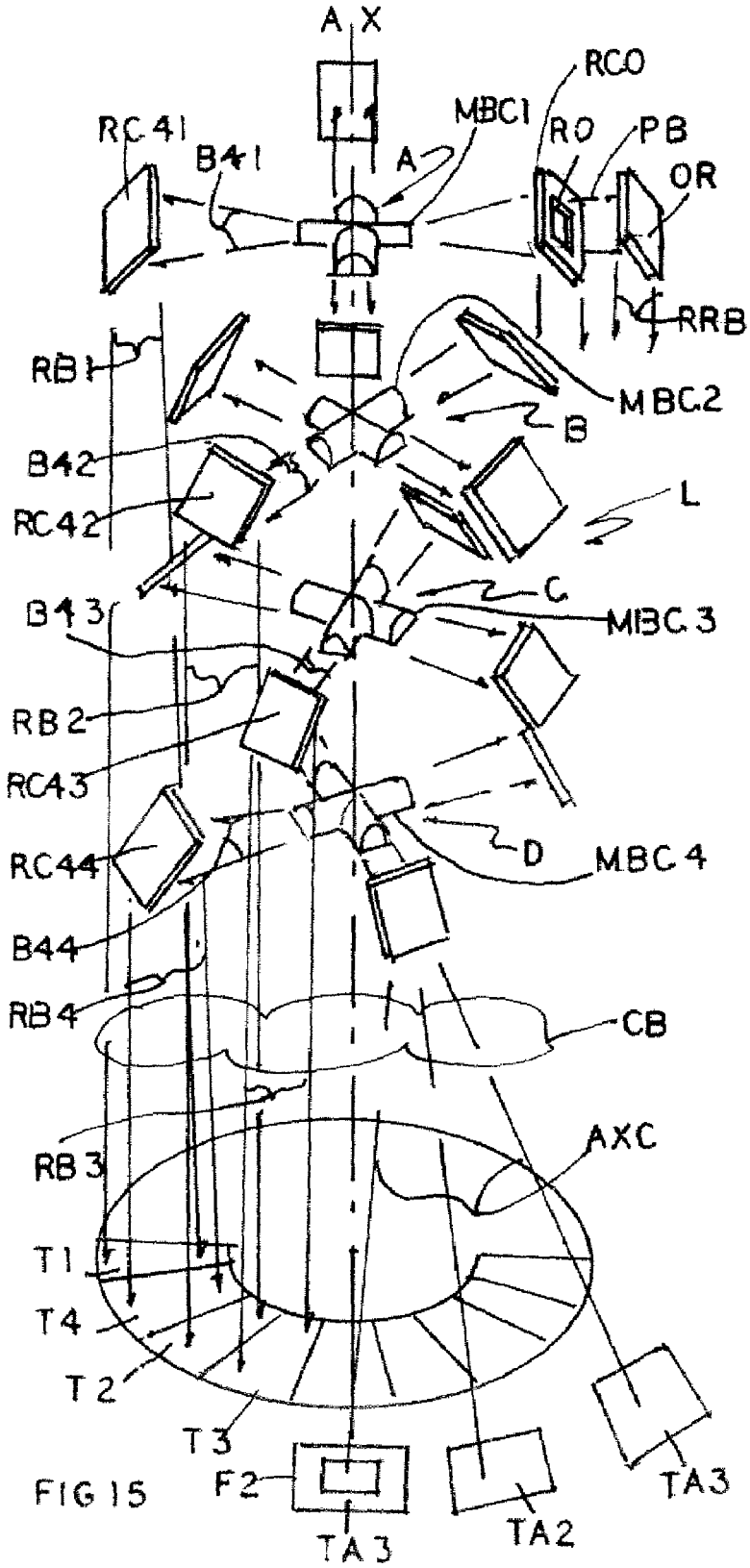

FIG. 15 is a luminaire L designed to project and create a pattern of beams that are projected from multiple beam projectors that are stacked and with a radial offset form one another. Each multiple beam module as (described in FIGS. 13/13A/13B/14/14A) MBC1, MBC2, MBC3 and MBC4 has is comprised of four beam projecting collimators disposed at 90° that project typical beams B41, B42, B43 and B44 respectively onto reflectors. The combined optical components MBC1 and RC41, MBC2 and RC42, MBC3 and RC43, and MBC4 and RC44 are labeled A, B, C and D respectively. In the illustrated luminaire of FIG. 15, A, B, C, and D are rotated about vertical axis AX at 22_°. The number of multiple beam modules the number of beam collimators within each module and the degrees of rotation from each other can vary from luminaire to luminaire. Also the color of the LED or other type of quasi point source within each module may vary from module to module. Typical beam B41, reflected by RC41 as Beam RB1 onto target area T1. In the same way B42 is reflected by RC42 as Beam RB2 onto target area T2, B43 is reflected by RC43 as Beam RB3 onto target area T3, B44 is reflected by RC44 as Beam RB4 onto target area T4 thus forming a circular cross-sectional pattern by composite beam CB. Any of the R reflectors can be tilted at an angle other that 90° to its associated beam causing the axis of the beam to be tilted along a radial axis of CB toward or away from AX. This is illustrated by the center angles AXC of a reflected beam shown to strike either of the three target areas TA1, TA2 or TA3, or any position in between. All the RB beams can therefore be focused upon a single target FT, or be projected into a light guide as illustrated in FIG. 8B. Also the cross-section of RC41, RC42, RCF3 and RC44 can be concave, convex or flat causing the cross-section of RB1, RB2, RB3 and RB4 to converge, divide or remain unchanged.

Figure 15A:
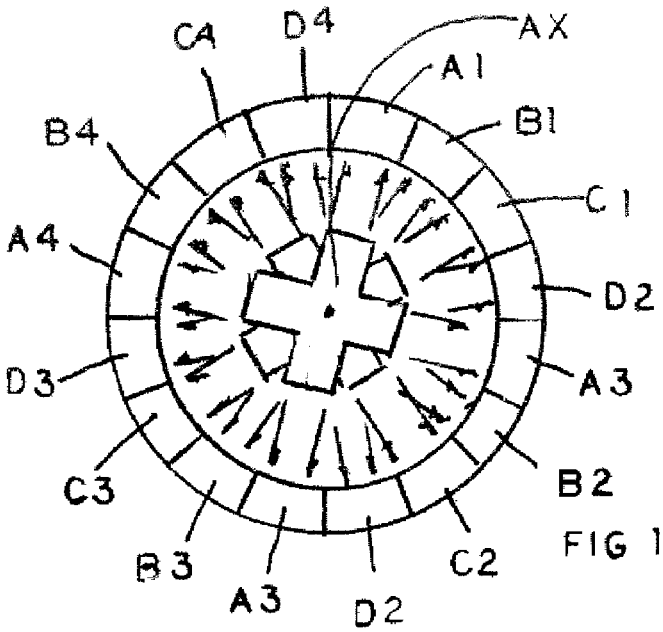

FIG. 15A illustrates the radial relationship between A, B, C, and D of FIG. 15. The beam axes of A lie on radii A1/AX, A2/AX, A3/AX and A4/AX. The beam axes of B Lie on B1/AX, B2/AX, B3/AX and B4/AX. The beams of axes C lie on C1/AX, C2/AX, C3/AX and C4/AX. The beam axes of D lie on D1/AX, D2/AX, D3/AX and D4/AX.

Figure 15B:
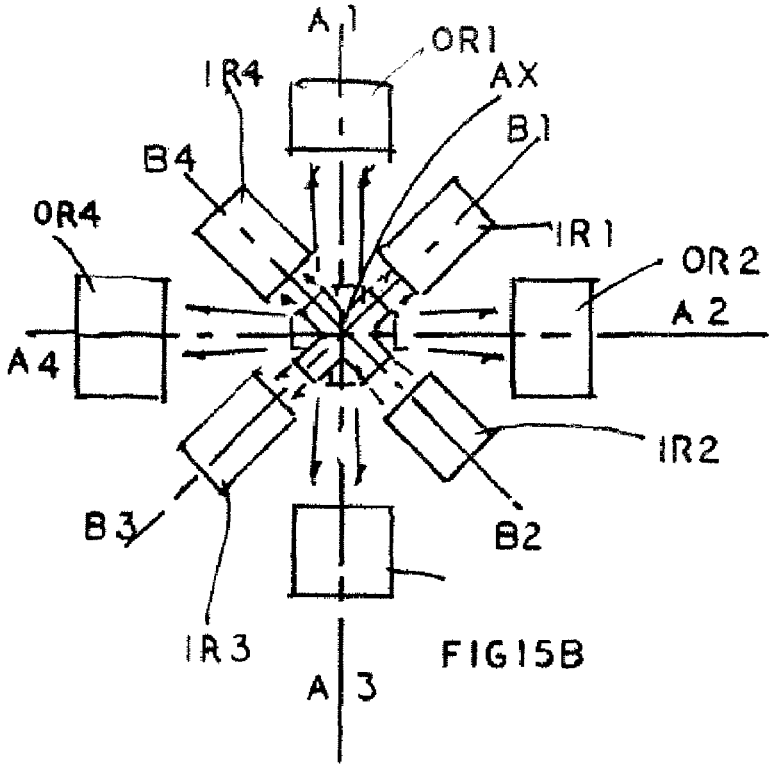

FIG. 15B is a luminaire similar to that described in FIG. 15, modified in that only two multiple beam projecting modules are stacked on axis AX. In FIGS. 15/15A all reflectors are on the same circumference while in FIG. 15B reflectors OR1, OR2, OR3 and OR4 on axis A1/AX, A2/AX, A3/AX and A4/AX lie on a circumference having a greater diameter than reflectors IR1, IR2, IR3, and IR4 on axis B1/AX, B2/AX, B3/AX and B4/AX. The patters of reflector location shown in FIGS. 15/15A/15B can be altered in relationship to the number of beam projecting components in each beam module and the number of modules used in a stack. Reflectors can be fabricated in a uniform structural body.

Figure 16:
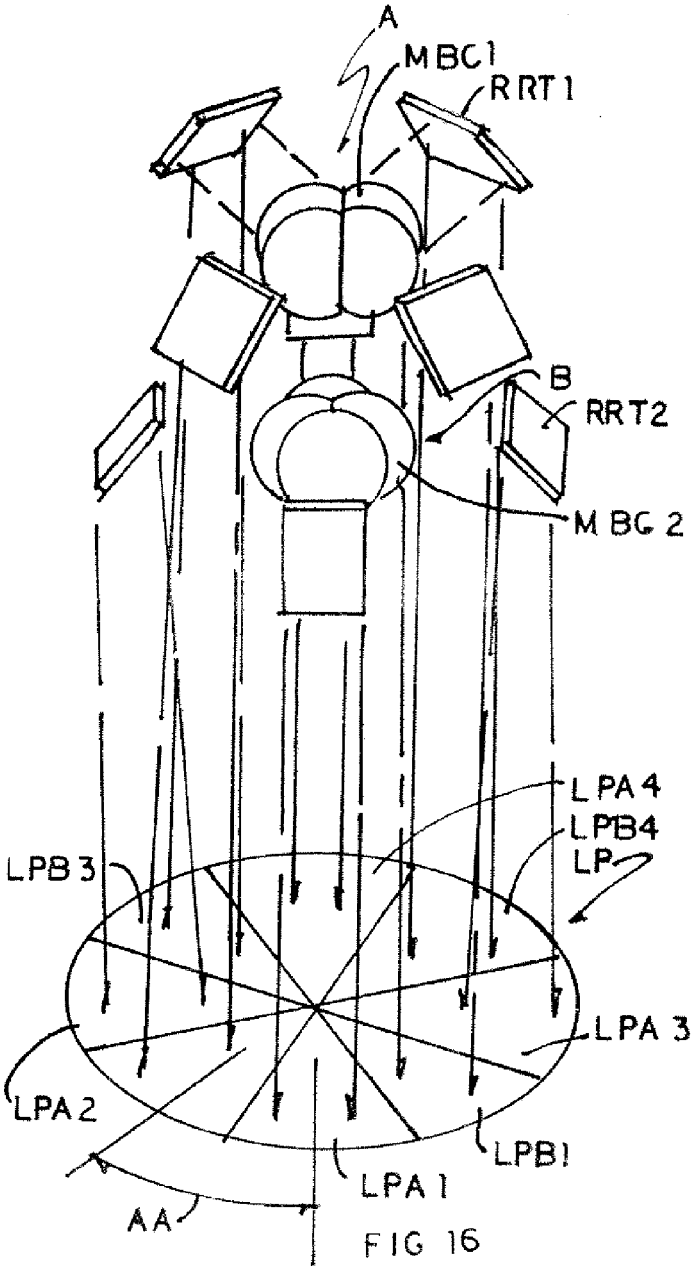

FIG. 16 illustrates a luminaire similar in function to that of FIG. 15. FIG. 16 shows two four multiple beam collimators (having similar optical configurations as shown in FIG. 14/14A) MBC1 and MBC2 each surrounded by sets of four mirrors RRT1 and RRT2 respectively. The combined optical composite of MB1 and RRT1, and MB2 and RRT2 are represented by A and B respectively. A and B are rotated at angle AA which is 45°. The resulting beam pattern LP is LPA1, LPA2, LPA3 and LPA4 projected by A, and LPB1, LPB2, LPB3 and LPB4 projected by B.

Figure 17:
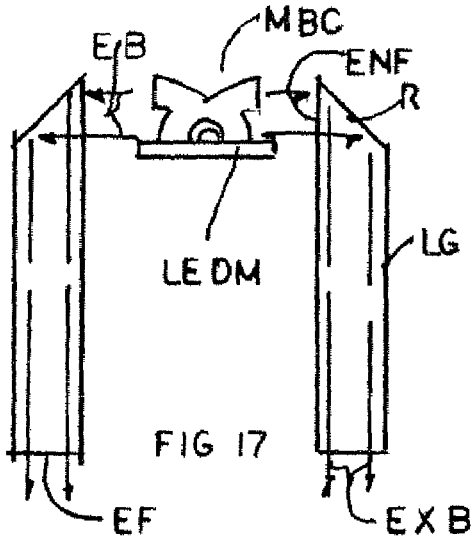

FIG. 17 shows an LEDM module (as illustrated in FIG. 13/13A/13B) projecting typical beam EB into the typical entry face ENF of hollow or solid typical light guide LG having a reflective or internally reflective typical surface R bending EB as typical beams RB through and out typical exit face EF as typical beams EXB.

Figure 17B:
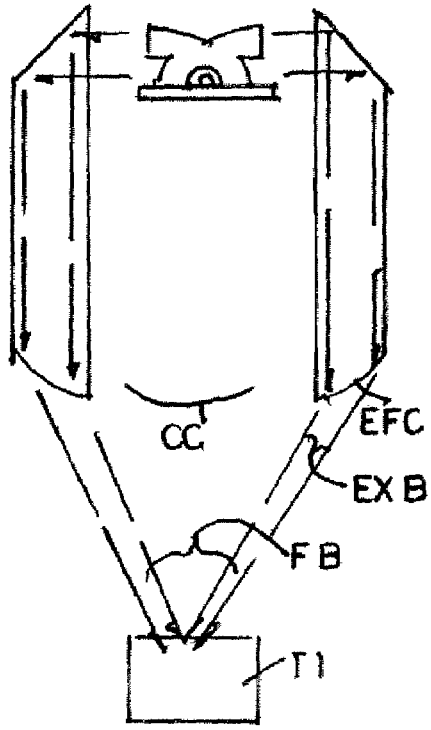
Figure 17A:
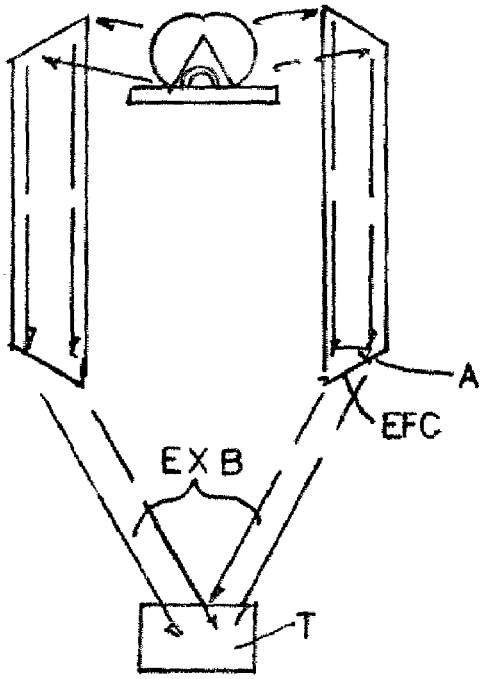

FIG. 17A is an optical assembly similar to that shown in FIG. 17 illustrating a cant in the typical exit face EFC represented by angle A causing exit beams EXB to be bent toward and onto target T.

FIG. 17B is an optical assembly similar to that shown in FIGS. 17/17A illustrating a convex surface CC shared by typical exit face EFC bending and focusing typical EXB forming a focused beam FB onto target T.

Figure 18:
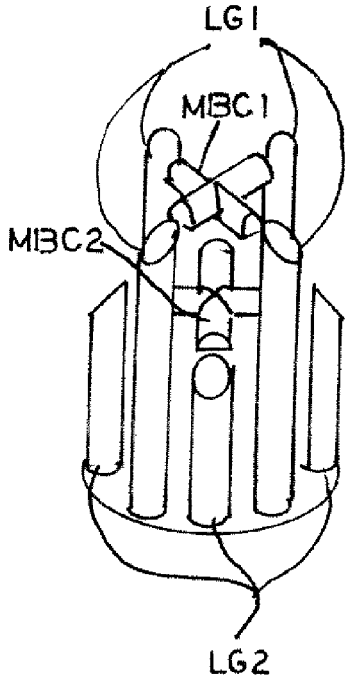

FIG. 18 is a diagram incorporating the function of FIG. 17 with the possible integration of FIGS. 17A/17B. Two multiple beam collimators MBC1 and MBC2 are stacked with a radial offset as in FIGS. 15/15A/15B/15C/16. Both MBC1 and MBC2 have corresponding groups of light guides LG1 and LG2. The eight light guides illustrated can be fabricated, extruded or molded as a unified structure.

Figure 18A:
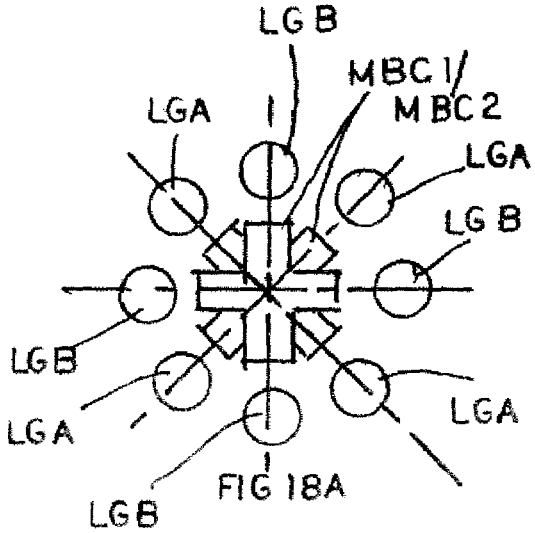

FIG. 18A is a diagram of FIG. 18 illustrating MBC1 and MBC2 with a radial offset surrounded by light guide grouping LGA and LGB respectively.

FIG. 20 is a diagram containing a LEDMD module and radial lenses RLA1 and RLA2 (similar to the same module and ring lenses of FIG. 8) enclosed in a rectangular or cylindrical container LB2, having an upper reflective surface UR, and a side reflecting surface SR which reflects conical redial beam CRBU onto diffusion surface DP. Conical radial beam CRBL is also projected onto DP overlapping CRBU.

FIG. 20A is a diagram similar to that for FIG. 20 differing in that LB3 contains a stack of three ring collimators 3RC.

Figure 21A:
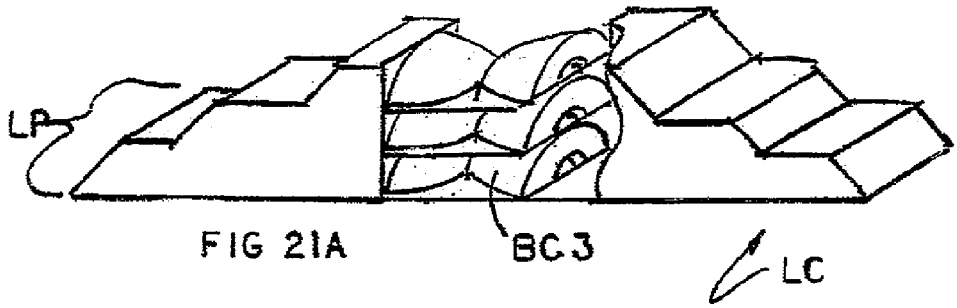
Figure 21B:
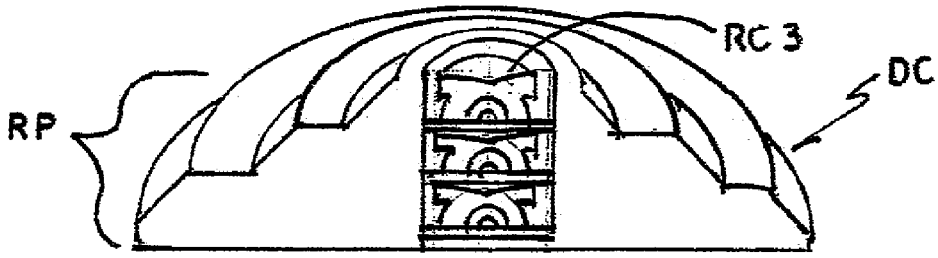
Figure 21C:
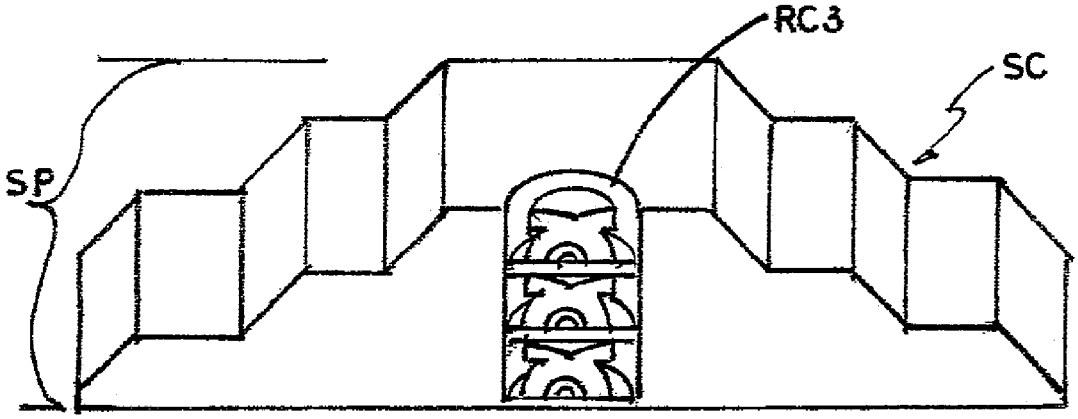
Figure 21D:
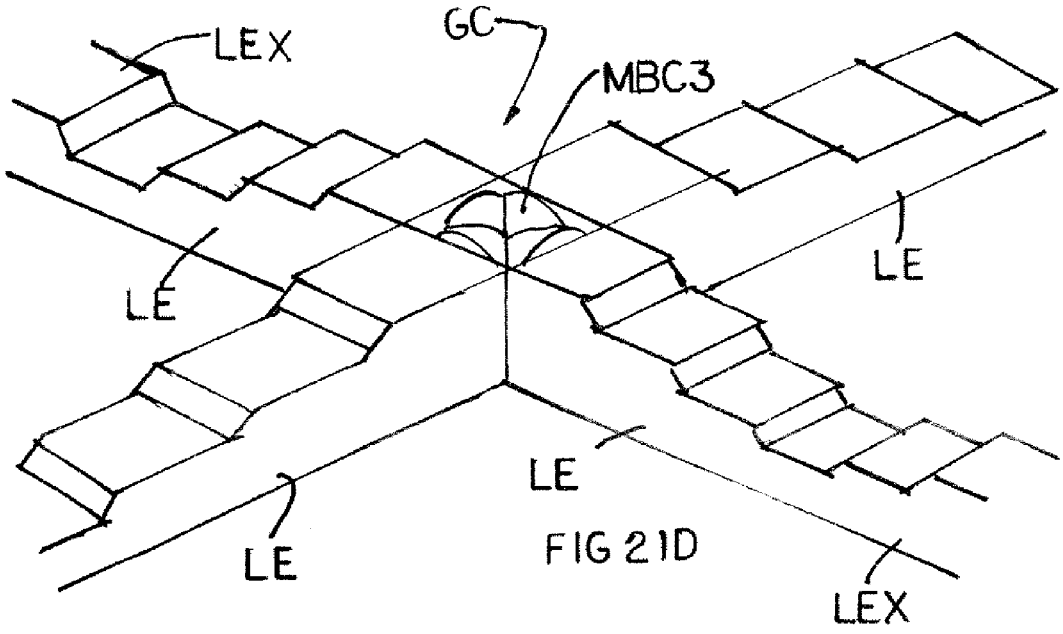

FIG. 21 is a view of four types of multi-tiered luminaire MTL, a round planar Luminaire illustrated in FIG. 21B, a linear luminaire illustrated in FIG. 21A or a grid type luminaire illustrated in FIG. 21D, a square (rectangular) planar luminaire illustrated in FIG. 21C, a stack of light collimating modules RC1, RC2, and RC3 that can (be of the type illustrated in FIGS. 13/13A/13B/14/14A or those having cross-sections similar to those illustrated in FIGS. 3A/3B/3C/4A/4B) project collimated beams B1, B2, and B3 respectively into and through light pathways LP1, LP2, LP3 respectively. The upper surface of LP1, LP2, LP3; RP1, RP2, and RP3 are internally reflective and are substantially parallel to B1, B2, B3 and are stepped at intervals forming canted reflective surfaces R1, R2, and R3, R4, R5, and R6, and R7, R8 and R9 respectively that segment B1, B2 and B3 respectably. The spacing intervals between R1, R2, and R3, R4, R5, and R6, and R7, R8 and R9 are such that as they intercept and reflect B1, B2 and B3 they do not block the reflected light from the other canted reflectors. The composite light from reflected beams B1, B2 and B3 is represented by rays CR. Accessory plate DP can be used to diffuse or modify CR if required.

FIG. 21A is a luminaire in a linear configuration LC comprised of a stack of three double beam collimators BC3 as part of an optical system LP having a similar sectional configuration and function as that of FIG. 21.

FIG. 21B is a a luminaire DC in a circular disk configuration comprised of a stack of three radial collimators RC3 as part of an optical system RP having a similar sectional configuration and in function to that FIG. 21.

FIG. 21C is a luminaire SC having a planar rectangular shape comprised of a stack of three radial collimators RC3 as part of an optical system SP having a similar sectional configuration and function to that of FIG. 21.

FIG. 21D is a luminaire GC in the form of intersecting linear configurations similar to LC of FIG. 21A differing in that of a stack of three four beam collimator MBC3 (FIG. 13A) is at the intersections of the linear elements LE. Elements LE are shown joining to elements LEX which are the ends of other GC luminaire thus forming a grid of GC luminaire. The sections though, and functions of GC are similar to that of the section shown in FIG. 21.

FIG. 21E is a diffusion plate DP as described in FIGS. 20 and 20A having either V groves, pyramid prisms or concave or convex pillow lens type surfaces, PL diffusing beams CRBL of FIG. 20 as diverging ray CRD.

Figure 22:
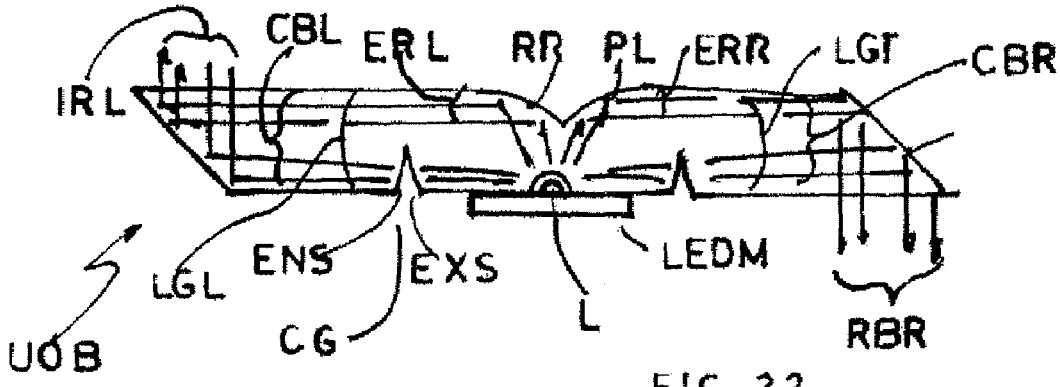

FIG. 22 is a unified optical body UOB at least partially surrounding L of LEDM. Rays ERR (on the right side of the diagram) and rays ERL (on the left side of the diagram) emanate from the upper portions L are reflected by parabolic surface PL and RR respectively and, EFR and EFL emanating from the side of L are refracted by collimating gap and combine to form collimated beams CBR and CBL respectively. Collimating gap CG is comprised of an exit surface EXS (that can be flat canted or convex) and an entry face ENS (that can be flat canted or convex in section). Combined collimated rays CBR and CBL pass though light guides LGR and LGL respectively. CBR and CBL are reflected by internal reflective surfaces IRR and IRL (which can be flat convex or concave in section). In this figure IRR and IRL are facing in opposite directions, therefore CBL is reflected by IRR and IRL can be changed in the same direction and therefore RBR and RBL would be projected in the same direction.

Figure 22A:
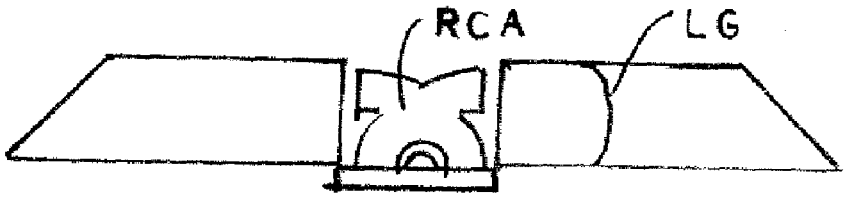

FIG. 22A is an alternate cross-section to that shown in FIG. 22 comprised of optical elements RCA which is described in FIGS. 3A1, 4B, 13, 13A, 13B and a light guide LG similar in function to that of LGR in FIG. 22.

Figure 23:
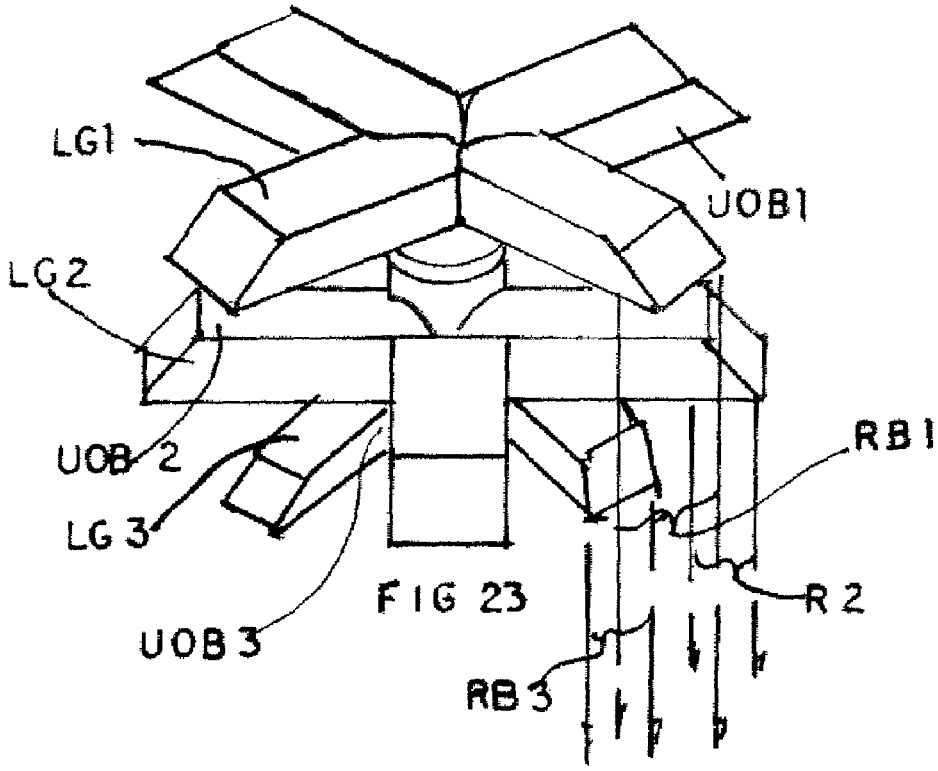

FIG. 23 is a luminaire L comprised of three optical configurations UOB1, UOB2 and UOB3 each with a cross-section similar to shown in FIG. 22. UOB1, UOB2 and UOB3 are shown to have four light guide arms shown typically as LG1, LG2 and LG3 although the number of light guide arms is not restricted to four. As described in FIG. 15/15A/16/18, the light guides LG1 and LG2 have a radial offset from each other and as in FIG. 15B, LG3 is concentrically offset from LG1 and LG2. Radial or concentric "offsets" keep optical components such as light guides or reflectors from interrupting typical reflected beams RB1, RB2 and RB3. Although this figure illustrates three stacked optical configuration UOB1, UOB2 and UOB3 more or less can be used.

Figure 24:
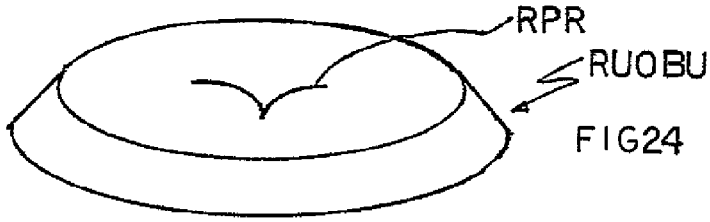
Figure 24A:
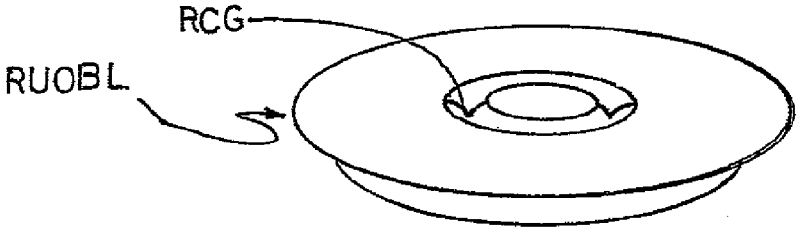

FIGS. 24 and 24A show an upper view RVOBU and a lower view RVOBL of a disk shaped optical configuration having a cross-section and function similar to that shown in FIGS. 22/22A. RUOBU illustrates radial parabolic form RPR and RUOBUL shows radial refractive surface RCG.

Figure 25:
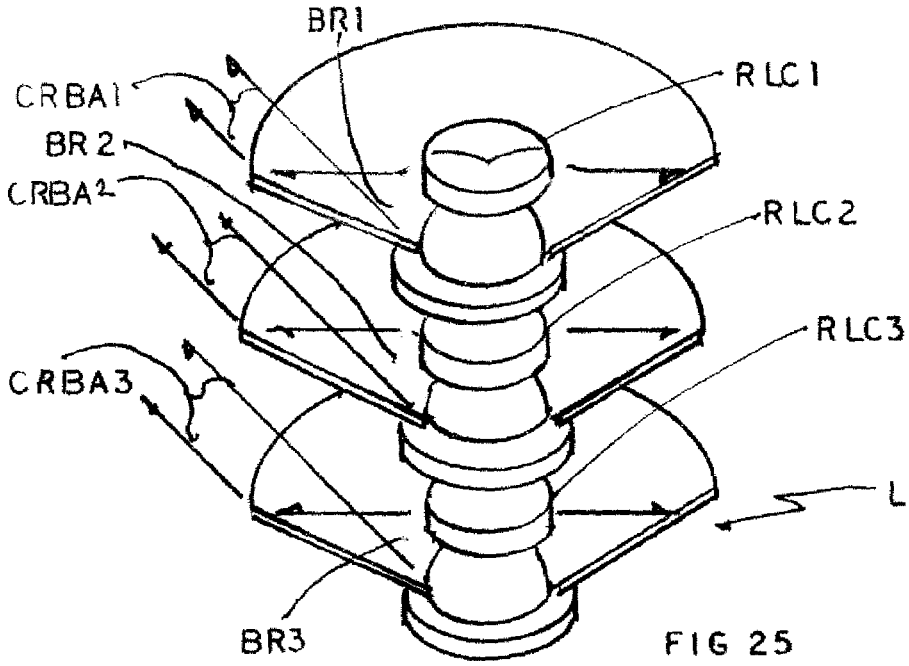

FIG. 25 is a cutaway three dimensional diagram of a luminaire L comprised of a stack of three modules RLC1, RLC2 and RLC3 similar in components and function to that shown in FIG. 5. RLC1, RLC2 and RLC3 are each at least partially surrounded conical reflectors BR1, BR2 and BR3 respectively, each reflecting radial light emanating from RLC1, RLC2 and RLC3 as canted radial beams CRBA1, CRBA2 and CRBA3 respectively.

Figure 25A:
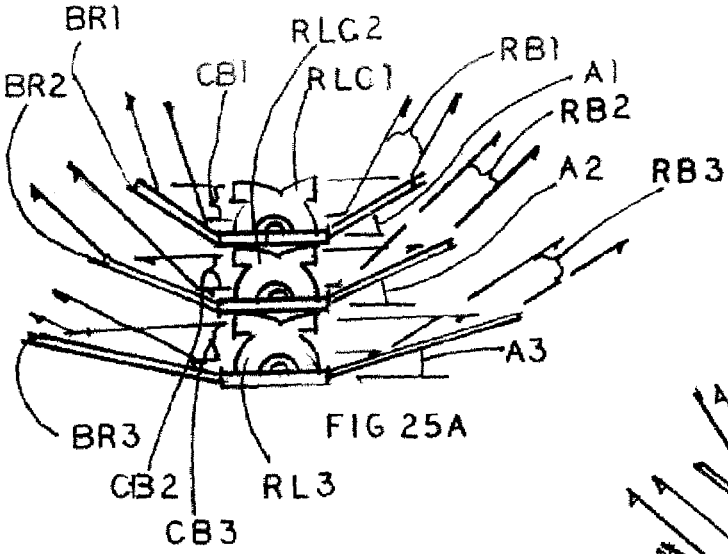

FIG. 25A is a luminaire L similar to L of FIG. 25 differing in that the cant angles A1, A2, and A3 of conical reflectors BR1, BR2 and BR3 are progressively more acute reflecting radial beams CB1, CB2 and CB3 as progressively more obtuse to the center axis CA of RLC1, RLC2 and RLC3.

Figure 26:
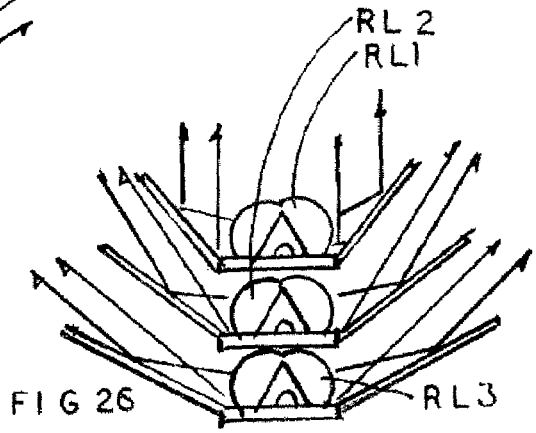

FIG. 26 is a luminaire L similar in cross-section and function to L of FIG. 25A differing in that RLC1, RLC2 and RLC3 of FIG. 25A has been replaced by RL1, RL2 and RL3 which are components described in FIG. 7.

It will now be apparent to those skilled in the art that other embodiments, improvements, details, and uses can be made consistent with the letter and spirit of the foregoing disclosure and within the scope of this patent, which is limited only by the following claims, construed in accordance with the patent law, including the doctrine of equivalents.

The invention claimed is:

1. A light projecting device, comprising:

a. a series of at least two stacked LEDs sharing a common optical axis;

b. a multibeam collimator surrounding each LED and including at least two identical individual geometrically arranged collimators each of which projects a beam of collimated light such that the plurality of individual collimators projects a plurality of individual collimated beams projected at an angle to the optical axis in a discontinuous radial pattern wherein each multibeam collimator is radially offset from the others; and c. a radial pattern of individual reflectors onto which the individual collimated beams are projected, said reflectors matching the discontinuous radial pattern of individual radial beams and only reflecting light projected from the associated individual collimator, each said individual reflector so positioned as to not obstruct an individual collimated beam projected from a non-associated individual collimator, and disposed such that said discontinuous pattern of projected beams is reflected by said associated pattern of matching reflectors as a continuous composite beam surrounding and projected in the direction of said optical axis.

2. A light projection device as in claim 1 wherein the individual reflecting surfaces redirect at least one of the individual linear beams at an angle to the common axis.

3. A light projecting device as in claim 1 wherein the reflecting surfaces are disposed so as to redirect the individual beams to overlap into a common focal point.

4. A light projecting device as in claim 1 wherein at least one of the multiple beam collimators is constructed as a unified reflecting optical body comprising an internally reflecting component and a refracting component.

5. The light projecting device as in claim 1 wherein the individual collimators of at least one of the multibeam collimators are canted at an angle to the optical axis each projecting a beam at an angle other than 90 degrees to the optical axis.

6. A light projecting device as in claim 1 wherein the multibeam collimators and the individual reflecting surfaces onto which the multibeam collimators are projected are internally reflecting and are molded as a unified internally reflected device.

7. A light projecting device as in claim 1 wherein the individual collimators comprise a refracting and a reflecting element.

8. A light projection device as in claim 1 wherein said individual collimators comprise reflectors.

9. A light projecting device as in claim 1 wherein said individual collimators comprise a reflective and a refractive element.

10. A light projecting device as in claim 1 wherein said individual linear linear collimators are lenses.

11. A light projecting device as in claim 1 wherein at least two of each of said individual reflectors are angled and disposed so as to reflect and direct a continuous composite beam onto an optical refractor.

12. A light projecting device, comprising:

a. a series of at least two stacked LEDs sharing a common optical axis;

b. a multibeam collimator surrounding each LED and including at least two identical individual geometrically arranged collimators each of which projects a beam of collimated light such that the plurality of individual collimators projects a plurality of individual collimated beams projected at an angle to the optical axis in a discontinuous radial pattern pattern wherein each multibeam collimator is radially offset from the others; and c. a plurality of individual linear, non-planar, light guides extending outwardly in a discontinuous radial pattern from said common optical axis and matching said plurality of individual collimated beams, each individual linear light guide intercepting and internally reflecting an individual collimated beam along and through said light guide, each light guide including at least one internally reflective surface to redirect said individually collimated beams at an angle away from said light guide, said individual beams being reflected to form a uniformly directed beam pattern in the direction of said optical axis away from said light projecting device.

13. A light projecting device as in claim 12 wherein the individual linear light guides are molded together as a unified optical body.

14. A light projecting device as in claim 12 wherein the multibeam collimator and said light guides are molded as a unitified optical body, each linear light guide is solid and has a linear collimation optic at the entrance aperture of the linear light guide and a reflecting optic at the exit end of the linear light guide.

15. A light projecting device as in claim 12 wherein each light guide is comprised of sequentially reflective surfaces along the light guides.

16. A light projecting device as in claim 12 wherein the configuration of light guides is fabricated as a geometric grid and an illumination device comprising a series of at least two multiple beam collimators which are contained within the junction of a solid light guide, further comprising internally reflecting or refracting surfaces successively along the guides.

17. A light projecting device as in claim 16 wherein there is only one multiple beam collimator at the junction of the light guides.

18. A light projecting device as in claim 12 wherein at least two of the individual light guides is substantially parallel to each other and the optical axis, each said light guide comprising a reflecting entry surface redirecting a linearly collimated beam through said light guide.

19. A light projecting device, comprising:

a. at least two LEDs disposed on an optical axis;

b. a multibeam collimator surrounding each LED and including at least two identical individual geometrically arranged collimators each of which projects a beam of collimated light such that the plurality of individual collimators projects a plurality of individual collimated beams projected at an angle to the optical axis in a discontinuous radial pattern wherein each multibeam collimator is radially offset from the others; and c. a plurality of individual linear, non-planar, light guides, each having an entry face and an exit face, each extending outwardly in a discontinuous pattern surrounding said common optical axis and matching said plurality of individual collimated beams, each individual linear light guide having an internally reflecting surface disposed adjacent to said entry face, intercepting and internally reflecting an individual collimated beam along and through said light guide, each of said individual light guides being substantially parallel to each other and the optical axis, and each multibeam collimator projecting a plurality of collimated beams into and through a plurality of light guides.

20. A light projecting device as in claim 19 wherein said exit faces of said light guides are shaped to direct said guided individual collimated light beams exiting said light guides onto a common target.

21. A light projecting device as in claim 20 wherein at least one of said exit faces of said light guide is shaped to focus and concentrate said individual collimated light beam exiling said light guide.

* * * * *